US007798109B2

(12) United States Patent
Jürging et al.

(10) Patent No.: US 7,798,109 B2
(45) Date of Patent: Sep. 21, 2010

(54) INTERNAL COMBUSTION ENGINE WITH A VARIABLE COMPRESSION RATIO

(75) Inventors: Michael Jürging, Kelkheim-Taunus (DE); Jens Meintschel, Esslingen (DE); Reinhard Orthmann, Leonberg (DE); Hubert Schnüpke, Stuttgart (DE); Dietmar Schröer, Remseck (DE)

(73) Assignee: Daimler AG, Stuttgart (DE)

( * ) Notice: Subject to any disclaimer, the term of this patent is extended or adjusted under 35 U.S.C. 154(b) by 465 days.

(21) Appl. No.: 11/978,141

(22) Filed: Oct. 27, 2007

(65) Prior Publication Data

US 2008/0173281 A1 Jul. 24, 2008

Related U.S. Application Data

(63) Continuation-in-part of application No. PCT/EP2006/003620, filed on Apr. 20, 2006.

(30) Foreign Application Priority Data

Apr. 30, 2005 (DE) ..... 10 2005 020 270

(51) Int. Cl.
*F02B 75/04* (2006.01)

(52) U.S. Cl. ..... 123/48 B; 123/78 E

(58) Field of Classification Search ..... 123/48 R, 123/48 B, 78 R, 78 E, 78 F
See application file for complete search history.

(56) References Cited

U.S. PATENT DOCUMENTS

| | | | |
|---|---|---|---|
| 2002/0043229 | A1 | 4/2002 | Yapici |
| 2003/0075125 | A1 | 4/2003 | Kreuter |
| 2004/0025814 | A1 | 2/2004 | Gray, Jr. |

FOREIGN PATENT DOCUMENTS

| | | |
|---|---|---|
| DE | 30 04 402 | 8/1981 |
| DE | 36 01 528 | 7/1987 |
| DE | 36 44 721 | 7/1988 |
| DE | 42 10 030 | 9/1993 |
| DE | 100 26 634 | 12/2001 |
| DE | 201 18 997 | 2/2002 |
| DE | 102 21 334 | 11/2003 |
| DE | 103 09 649 | 9/2004 |
| EP | 0 640 176 | 5/1997 |
| EP | 1 307 642 | 5/2004 |
| EP | 1 426 585 | 6/2004 |
| EP | 1 505 277 | 2/2005 |
| GB | 2 406 614 | 4/2005 |
| JP | 2002 174132 A | 6/2002 |
| JP | 2005 083203 A | 3/2005 |

*Primary Examiner*—Noah Kamen
(74) *Attorney, Agent, or Firm*—Klaus J. Bach

(57) ABSTRACT

In an internal combustion engine including a housing with cylinders arranged in the housing, a crankshaft, and pistons moveably disposed in the cylinders and operatively connected to the crankshaft, and a device for changing the compression ratio of the cylinders of the internal combustion engine, the device comprises an adjusting arrangement with an eccentric which is mounted in the housing and, by means of rotation, controls the position and the direction of movement of the adjusting arrangement, and a drive for operating the adjusting arrangement including the eccentric.

13 Claims, 6 Drawing Sheets

INTERNAL COMBUSTION ENGINE WITH A VARIABLE COMPRESSION RATIO

This is a Continuation-in-Part Application of pending international patent application PCT/EP2006/003620 filed Apr. 20, 2006 and claiming the priority of German patent application 10 20050202270.5 filed Apr. 30, 2005.

BACKGROUND OF THE INVENTION

The invention relates to an internal combustion engine with cylinders including pistons movably disposed therein via a crankshaft and piston rods and an arrangement for changing the compression ratio of the cylinders and also a method for operating an internal combustion engine with a variable compression ratio.

EP 1 307 642 B1 discloses a reciprocating-piston internal combustion engine having a device for varying the compression ratio. The device has, for one cylinder of the internal combustion engine, a main piston rod which is connected to a piston, a transverse lever which is connected by means of revolute joints to the main piston rod and to the crankshaft, an auxiliary piston rod which is connected by means of revolute joints to the transverse lever and to an eccentric, and a drive device for an adjusting shaft on which is arranged an eccentric which is assigned to the at least one cylinder.

By means of rotation of the adjusting shaft and therefore by means of rotation of the eccentric, the position and the setting of the auxiliary piston rod and of the transverse lever is varied, whereby for a constant position of the crankshaft, the main piston rod is moved. The position of the piston of the internal combustion engine is therefore moved, and the compression ratio is varied. The adjusting shaft with the eccentric performs a rotational movement which is synchronous with the crankshaft, or it is rotated by means of an adjusting device (not shown). The device is suitable for adjusting the compression ratio while simultaneously improving the running smoothness of the engine.

DE 30 04 402 A1 discloses a device for adjusting the compression ratio of reciprocating-piston internal combustion engines in which the center of the crankshaft can be adjusted relative to the position of the cylinder by means of an eccentric bearing arrangement, whereby the compression ratio is varied.

EP 0 640 176 B1 likewise discloses a device for adjusting the compression ratio of reciprocating piston internal combustion engines, in which the cylinders are tilted relative to the housing of the internal combustion engine by means of an eccentric, which is mounted on an adjusting shaft, and levers. In this way, the position of the upper edge of the cylinder relative to the center of the crankshaft is varied, and, as a result, the compression ratio is changed during the adjusting process.

DE 102 21 334 A1 likewise discloses a device for adjusting the compression ratio of reciprocating-piston internal combustion engines, in which, similarly to EP 0 640 176 B1, the upper edge of the cylinder is moved relative to the center of the crankshaft. In this case, the upper part of the cylinder housing is moved in a translatory fashion by means of two eccentrics which are mounted on adjusting shafts, and the compression ratio is thereby varied.

DE 100 26 634 A1 likewise discloses a device for adjusting the compression ratio of reciprocating-piston internal combustion engines, in which an eccentric is arranged between the piston rod and the piston of the internal combustion engine. Said eccentric can be adjusted externally by an adjusting shaft via levers, whereby the compression ratio is likewise varied.

A feature of all of said reciprocating-piston internal combustion engines is the variation of the compression ratio by means of the rotation of at least one adjusting shaft.

It is the principal object of the present invention to provide, a compression ratio adjusting device which is operable at all times in a simple manner and with little energy input.

SUMMARY OF THE INVENTION

In an internal combustion engine including a housing with cylinders arranged in the housing, a crankshaft, and pistons moveably disposed in the cylinders and operatively connected to the crankshaft, and a device for changing the compression ratio of the cylinders of the internal combustion engine, the device comprises an adjusting arrangement with an eccentric which is mounted in the housing and, by means of rotation, controls the position and the direction of movement of the adjusting arrangement, and a drive for operating the adjusting arrangement including the eccentric.

The device for changing the compression ratio includes an adjusting lever which, directly or via intermediate levers, varies the length of the piston rod, the lift of the crankshaft and/or an upper edge of the cylinder in terms of its distance from the center of the crankshaft. An eccentric is mounted in the housing and, by rotation, changes the compression ratio during rotation of the adjusting shaft, that is, by rotation of the eccentric.

A distinction is made between three operating states:

adjusting to increase the compression ratio, adjusting to reduce the compression ratio, and maintaining the setting.

In order to rotate the adjusting shaft, energy must be supplied. When maintaining the present setting, a rotation of the adjusting shaft must be prevented. When adjusting to a low compression ratio, the energy supply takes place by means of the gas pressure, with a free rotation of the adjusting shaft being permitted in that neither the clutch nor the brake bring about a force-fitting connection to the internal combustion engine. The integral value of the gas pressure of a cylinder is, at every operating point during a working cycle, greater than the ambient pressure, but also greater than the integral value of the gas pressure in the case of a relatively low compression. Said pressure difference of the integral gas pressure between high and low compression is sufficient to thereby trigger, and drive, an adjusting process in the direction of low compression. The gas pressure has a different effect depending on the adjusting device. For example, in the case of a device for adjusting the compression ratio which acts by means of a length variation of the piston rod, the effective piston rod length will be reduced. In the case of a device which acts by means of a variation in the piston lift, the piston lift is reduced. In the case of a device which moves the upper edge of the cylinder and therefore raises and/or tilts the cylinder head and the cylinders, the low compression is set by raising the upper edge of the cylinders.

If the adjusting shaft is not blocked, it will therefore automatically rotate in the direction of low compression.

The energy for adjusting to a high compression ratio is provided by the crankshaft of the internal combustion engine. This takes place by means of a drive device between the crankshaft and the adjusting shaft, which can be connected by means of a clutch for the time period of the adjusting process. That is to say that, for adjusting in the direction of high compression, the adjusting shaft is connected to the crankshaft by means of a clutch which is engaged during the adjustment, and the adjusting energy is transmitted via the crankshaft and if appropriate further transmission elements. The clutch is for example an electrically or hydraulically operated clutch. In one preferred embodiment of the invention, the clutch is an eddy current clutch or hysteresis clutch which operates in a contact-free fashion.

For maintaining the momentary setting of the compression, the adjusting shaft is prevented from rotating. This takes place by means of a brake device which blocks movement of the adjusting shaft relative to the housing of the internal combustion engine. In this case, the clutch is open. The brake device can be constructed as a friction brake or as a mechanical locking mechanism. Said brake device connects the adjusting shaft not to the crankshaft but rather to the housing. The brake device is for example electrically or hydraulically actuated. The advantage of the brake device is that, while the latter is actuated, the clutch can be released completely, and there are therefore no more power losses at the clutch. Said power losses result ultimately from the rotational movement of the internal combustion engine and are therefore part of the friction losses of said internal combustion engine. In addition, no electrical actuating power for the clutch is needed. Said electrical actuating power is greater than the electrical actuating power for the brake device, in particular in the case of using a brake device with a mechanical locking mechanism.

An actuation of the brake device and the takes place by means of a control unit as a function of the operating point of the internal combustion engine, with the following operating states being provided:

clutch engaged, brake device disengaged, clutch disengaged, brake device engaged, or clutch and brake device disengaged.

In one embodiment of the invention, the drive device for the adjusting shaft has a gearing. The gearing serves to convert the rotational movement of the crankshaft preferably in a step-down fashion, in order to thereby provide for an opening or closing of the clutch or of the brake device in a more simple and more precise manner. With a slow rotation of the adjusting shaft, it is simpler to obtain a targeted engagement at the desired time. Since a variation of the compression ratio need not take place within one crankshaft rotation, it is advantageous for the rotational speed of the adjusting shaft to be converted, by means of a gearing arranged between the crankshaft and the adjusting shaft in a step-down fashion, in such a way that a plurality of crankshaft rotations are required for an adjusting process, whereby the adjusting accuracy rises. By using a gearing, the torque which is to be controlled and therefore the power losses which are generated at the clutch are significantly reduced. It is hereby possible to control the position of the adjusting shaft, and therefore the compression ratio, solely by means of the clutch torque in interaction with the reverse torque from the gas force. For this purpose, the position of the adjusting shaft is advantageously measured by means of a sensor.

In a further embodiment of the invention, the drive device for the adjusting shaft can be connected to a drive of the camshaft. The drive of the camshaft of the internal combustion engine generally takes place by means of a wraparound drive, such as for example a chain drive or toothed-belt drive, or by means of a rolling contact gearing such as for example a single-stage or multi-stage gearwheel mechanism. It is advantageous, to drive the drive device with the gearing, the adjusting shaft, the brake and the clutch from said gearing via an intermediate wheel or deflecting wheel. In addition, the drive device for the adjusting shaft can be connected to a belt drive for driving auxiliary units of the internal combustion engine.

In a further embodiment of the invention, a housing-mounted stop is provided which limits a rotation of the adjusting shaft at a first end position. By means of a stop, it is possible in a simple manner to define or delimit a position of the adjusting shaft for example for high compression, so that when varying the compression in the direction of high compression, the adjusting shaft is limited in its rotation at a first end position. No multiple rotation of the adjusting shaft takes place. The clutch is designed so as to slip and/or immediately open when the adjusting shaft abuts the stop.

In a further embodiment of the invention, a second housing-mounted stop is provided which limits a rotation of the adjusting shaft at a second end position which is situated opposite the first end position. During a rotation in the direction toward low compression, the rotational movement is, similarly to the adjustment toward high compression, limited by a housing-mounted stop in order to thereby prevent a free rotation of the adjusting shaft. In addition, it is possible by means of the stops to prevent a position of the adjusting shafts in which the eccentric and the auxiliary piston rod are situated in a dead center position with respect to one another. A dead center position is pre-sent when the eccentric and the auxiliary piston rod assume an angle of 180° or 0° with respect to one another. In order to avoid the dead center positions between the eccentric and the auxiliary piston rod, it is advantageous to define the greatest possible adjusting range of the adjusting shaft to be an angle of less than 180°.

In a further embodiment of the invention, a rotational angle of the adjusting shaft between the first and the second stop is in a range from 100° to 150°. With a rotational angle between the two stops of between 100° and 150°, the adjusting angle of the adjusting shaft also lies in said range. It is thereby possible to obtain a sufficient adjusting range, and there is still a sufficient clearance distance at both stops from the respective dead center positions.

In a further embodiment of the invention, a spring is provided which rotates the adjusting shaft in the direction of a stop. By means of a spring, it is possible on the one hand for the adjusting process to be assisted and accelerated, and it is additionally possible to hold the adjusting shaft against the stop by means of the spring. In the case of the spring being designed as an over-dead-center spring, it is also possible by means of one spring to hold the adjusting shaft in each case against both stops. The adjusting process in the direction of low compression takes place on account of the integral pressure difference between high and low compression. In order to assist the adjusting process in the direction of low compression, it is advantageous for this purpose to provide a spring for assisting the adjusting process.

The method according to the invention is characterized in that the compression is changed in the direction of higher compression by closing the clutch, with the energy for rotating the adjusting shaft being extracted from the crankshaft by means of a wraparound drive and/or rolling contact gearing. The hydraulically or electrically actuated clutch is closed for the time period of the adjusting process, so that the energy for rotating the adjusting shaft can be extracted for example from the camshaft drive. By means of a gearing, the rotational speed of the adjusting shaft is reduced in relation to the crankshaft rotational speed in order to permit accurately timed closing and opening of the clutch. When the adjusting shaft is rotated to the stop, the clutch is opened.

In one embodiment of the method according to the invention, the compression ratio is changed in the direction of low compression by opening the clutch and the brake. Here, the energy for rotating the adjusting shaft is extracted directly from an integral gas pressure of the combustion in a combustion chamber above the piston. The duration and speed of the adjusting process is dependent on the difference between the present compression and the smallest possible compression. When the smallest possible compression is reached, the rotational movement of the adjusting shaft is limited by a stop.

In a further embodiment of the invention, the change of the compression in the direction of low compression is assisted by a spring. Since the duration and speed of the adjusting process are dependent on the difference between the present compression and the smallest possible compression, it is advantageous to assist the rotational movement by means of a spring in order to thereby obtain a reliable and fast movement to the stop.

In a further embodiment of the invention, in an operating state without change of the compression ratio, the brake device blocks any rotation of the adjusting shaft, and the clutch is opened. As a result of a blockage of the adjusting shaft by means of the brake device, the compression ratio of the internal combustion engine cannot be changed. In order to prevent damage to the transmission, to the drive device or to the stops, it is necessary to open the clutch which connects the adjusting shaft to the crankshaft or to the camshaft drive. In order to prevent blocking of the device and therefore possible damage, it is advantageous to design the transitions between the individual operating states to be continuous, and if appropriate to provide an overload clutch or slipping coupling. This occurs preferably by means of a hydraulic or electrical actuation of the brake device and the use of an eddy current or hysteresis clutch which can control both continuous transitions and also slipping or targeted differential rotational speeds.

Further features and combinations of features will become apparent from the following description on the basis of the accompanying drawings. Exemplary embodiments of the invention are illustrated below in simplified with reference to the accompanying drawings.

DESCRIPTION OF PARTICULAR EMBODIMENTS

Figure 1:
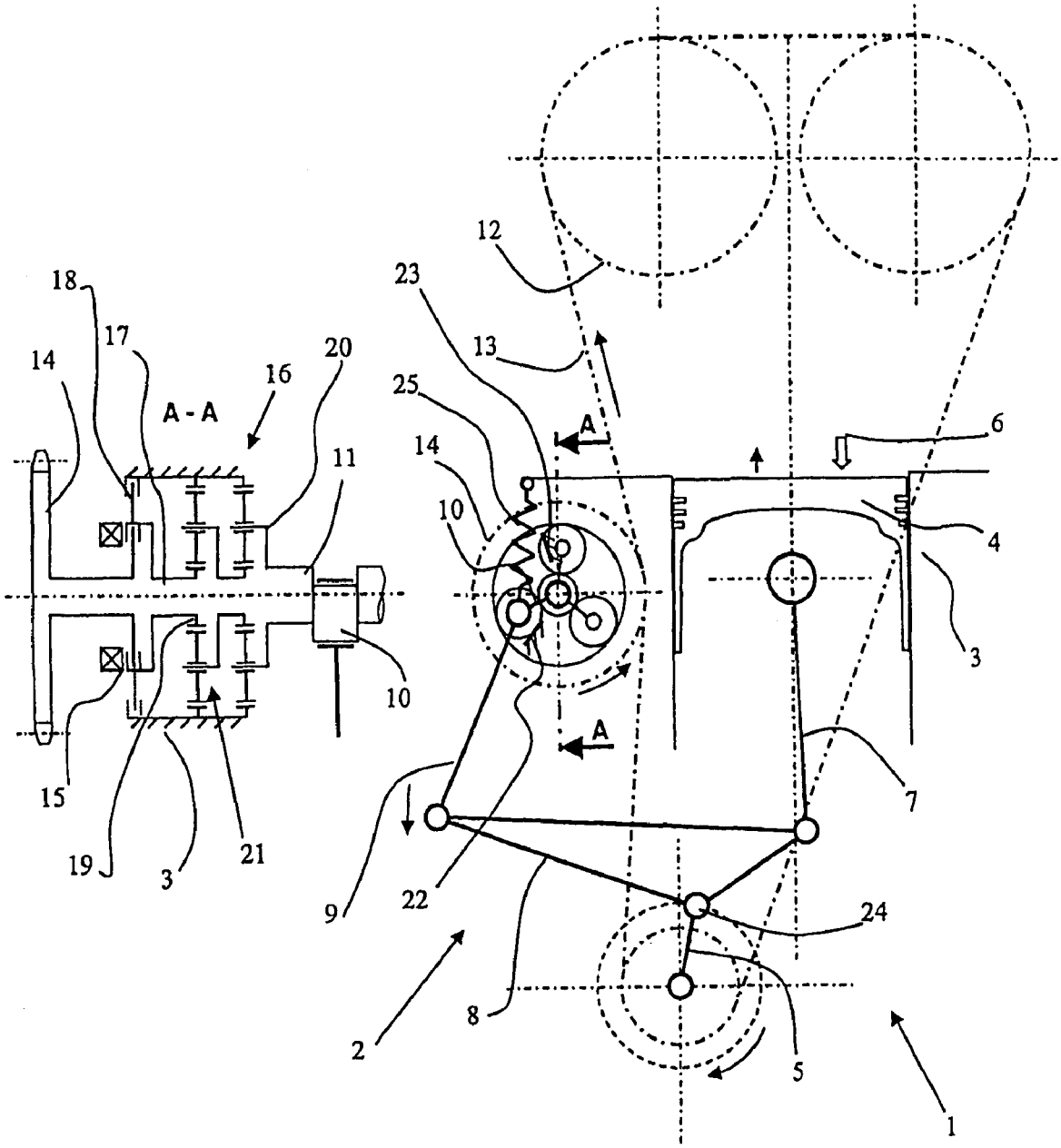
FIG. 1 is a schematic illustration of a device for changing the compression ratio of an engine including a transverse lever and an auxiliary connecting rod in a setting for high compression ratio.

FIG. 1 shows, schematically in a cross section and a partial longitudinal section, an internal combustion engine 1 having a device 2 for varying the compression ratio, in an operating state of the adjustment in the direction of a high compression. The internal combustion engine 1 has a housing 3 in which the piston 4 and the crankshaft 5 move. The piston 4 is moved downward by the gas force 6 and transmits said movement via the main piston rod 7 and the transverse lever 8 to the crankshaft 5. The transverse lever 8 is supported by means of the auxiliary connecting rod 9 on the eccentric 10 which is itself arranged on the adjusting shaft 11.

The internal combustion engine 1 additionally has two camshafts 12 which are driven via a wraparound drive 13, for example a chain drive, by the crankshaft 5. The wraparound drive 13 additionally drives a sprocket 14 which is connected by means of a switchable clutch 15 and a two-stage gearing 16 to the adjusting shaft 11. The switchable clutch 15 is embodied for example as an electromagnetic eddy-current clutch or hysteresis clutch which can be actuated quickly and precisely. The input-side shaft piece 17 of the gearing 16 can be connected both by means of the clutch 15 to the sprocket and also by means of the brake device 18 to the housing 3. The brake device 18 is embodied for example as a form-fitting lock-up brake with electromagnetic actuation. As a result of the form-fitting connection, it is possible to reduce the pressing force and therefore the electrical power which is consumed.

The gearing 16 is embodied as a two-stage planetary gear set 21 in which the internal gears are in each case supported on the housing 3 and the input-side sun gear 19 is connected to the shaft piece 17 and the output-side web 20 is connected to the adjusting shaft 11. The two-stage planetary gear set 21 converts the rotational speed of the sprocket 14 into a low rotational speed of the adjusting shaft 11. In addition, two housing-mounted stops 22, 23 are provided for the adjusting shaft 11, which stops 22, 23 delimit a possible rotational angle of the adjusting shaft to approximately 100° to 150°.

An adjusting process from a low to a high compression ratio takes place with the following method steps: the crankshaft 5 rotates clockwise and drives the wraparound drive 13. As a result, the sprocket 14 is rotated counter to the crankshaft 5. If the operating range of the internal combustion engine 1 is adjusted in the direction of high compression, the clutch 15 is closed in a manner triggered by a control unit (not shown). The rotational movement is therefore transmitted via the shaft piece 17 and the planetary gear set 21 to the adjusting shaft 11. On account of the high transmission ratio in the two-stage planetary gear set 21, the adjusting shaft 11 rotates counter to the crankshaft rotational direction, but significantly slower. The rotation takes place up to a contact with first stop 22, wherein, when the adjusting shaft or a stop mating piece which is fastened thereto abuts the first stop 22, the clutch 15 is opened or at least slips in order to avoid damage. When rotating the adjusting shaft 11 in the direction toward a high compression ratio, the eccentric 10 and the auxiliary piston rod 9 are placed into a virtually stretched-out position, with the first stop 22 preventing a dead-center position in an entirely stretched-out position. As a result of the rotation of the eccentric 10 and the movement of the auxiliary connecting rod 9, the transverse lever 8 is rotated about its point of articulation 24 to the crankshaft 5. The rotation of the transverse lever 8 brings about a movement of the main piston rod 7 and of the piston 4 upward. This movement of the piston 4 is superposed on the normal oscillating piston movement and, at the top dead center of the piston movement, generates a higher piston position and therefore a higher compression in relation to a position of the adjusting shaft 11 before the latter is rotated. Said high compression is maintained for as long as the adjusting shaft 11 bears against the first stop 22.

Figure 2:
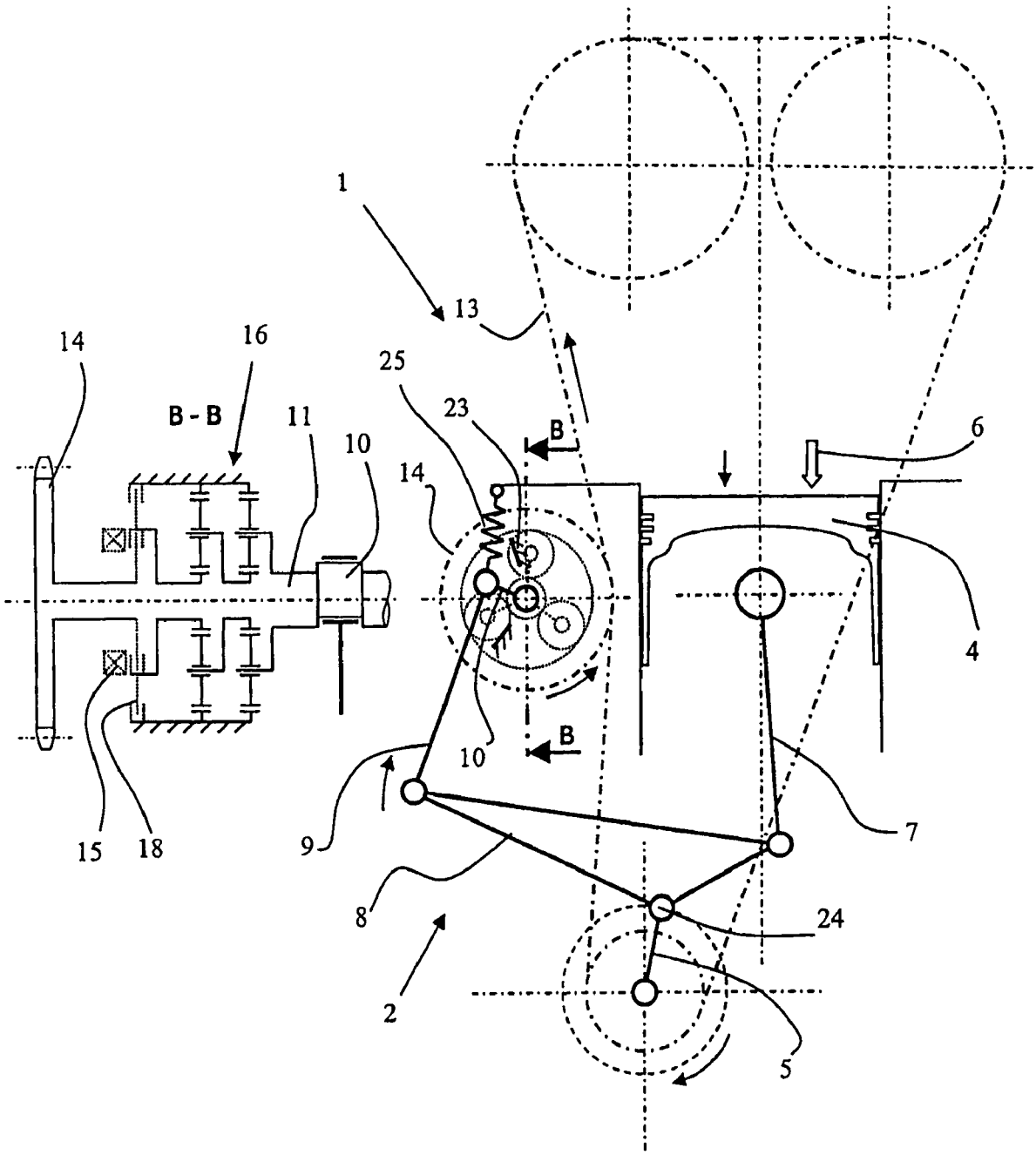
FIG. 2 is a schematic illustration of a device for changing the compression ratio including a transverse lever and an auxiliary connecting rod in a setting for a low compression ratio.

FIG. 2 illustrates, schematically in a cross section and a partial longitudinal section, an internal combustion engine 1 having a device 2 for varying the compression ratio, in an operating state of the adjustment to low compression. The same terms and reference symbols as those in FIG. 1 are applicable here.

An adjusting process to low compression of the internal combustion engine 1 takes place with the following method steps: both the clutch 15 and also the brake device 18 are released as a result of a signal of the control unit (not shown). The sprocket 14 is driven by the chain of the wraparound drive 13 and rotates loosely with the latter. The gearing 16 transmits no forces, as a result of which the adjusting shaft 11 can freely rotate. The integral gas pressure which is greater at high compression than at low compression (illustrated as gas force 6) presses the piston 4 and the main piston rod 7 downward. The transverse lever 8 is thereby pivoted about its point of articulation 24 on the crankshaft 5, and the auxiliary connecting rod 9 rotates the eccentric 10 and the adjusting shaft 11. Said rotational movement of the adjustment shaft 11 is assisted by the spring 25, which also rotates the adjusting shaft 11 to the second stop 23, since the adjusting force from the integral gas pressure is small and virtually disappears close to the dead center on account of the lever ratios between the eccentric 10 and the auxiliary piston rod 8. The two stops 22, 23 are arranged such that a sufficient clearance distance from a dead-center position is always maintained between the adjusting shaft 11 and the auxiliary connecting rod 9. A dead-center position between the adjusting shaft 11 and the auxiliary connecting rod 9 lies at an angle of 0° or 180° between the directions of action of the two components.

An adjustment toward a high or a low compression ratio takes place during continued operation of the internal combustion engine 1 at any desired operating point and is triggered by a control unit as a function of various parameters such as load, rotational speed, fuel quality, temperature and the like.

Figure 3:
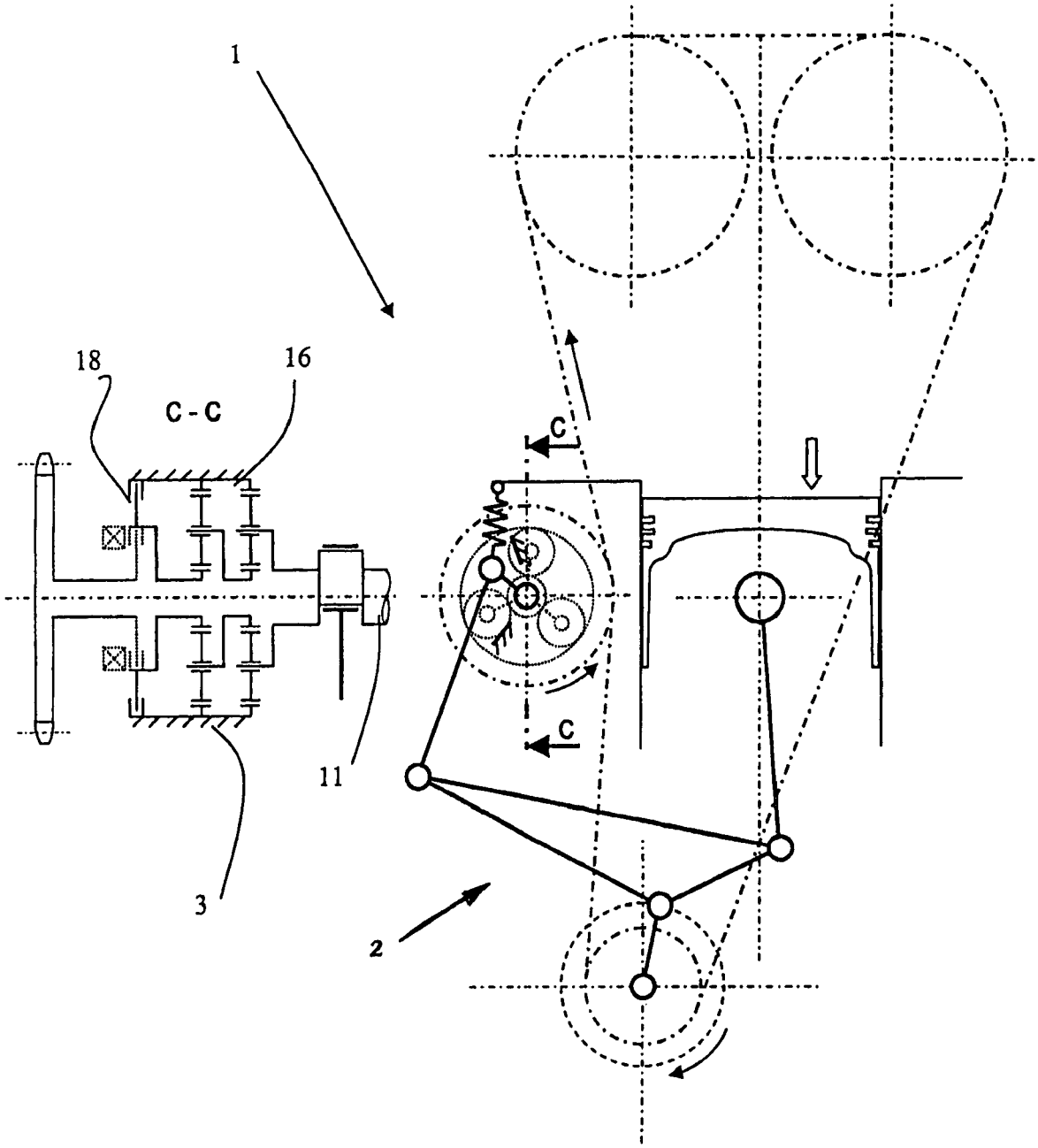
FIG. 3 is a schematic illustration of a device for changing the compression ratio including a transverse lever and an auxiliary connecting rod in a setting with the adjusting shaft blocked.

FIG. 3 illustrates, schematically in a cross section and a partial longitudinal section, an internal combustion engine 1 having a device 2 for varying the compression ratio, in an operating state with the adjusting shaft blocked. The same terms and reference symbols as those in FIG. 1 and FIG. 2 are applicable here.

In this case, the brake device 18 is closed, that is to say the gearing 16 is blocked by the housing 3 and the adjusting shaft 11 does not rotate. In this way, the compression of the internal combustion engine 1 is not changed that is it remains at a preset value. The brake device 18 can be closed in a position for high compression, low compression or any desired intermediate position.

The brake device is actively closed, that is to say that it is opened without any actuation. In the event of a failure of the actuation, of the clutch 15 or of the brake device 18, a position of the adjusting shaft 11 with low compression is automatically assumed. In this way, it is possible for the internal combustion engine 1 to continue to operate without risk with reduced power under some circumstances, as a result of which it is possible, for example in the case of use in a motor vehicle, to travel on to a repair shop under the vehicle's own power.

Figure 4:
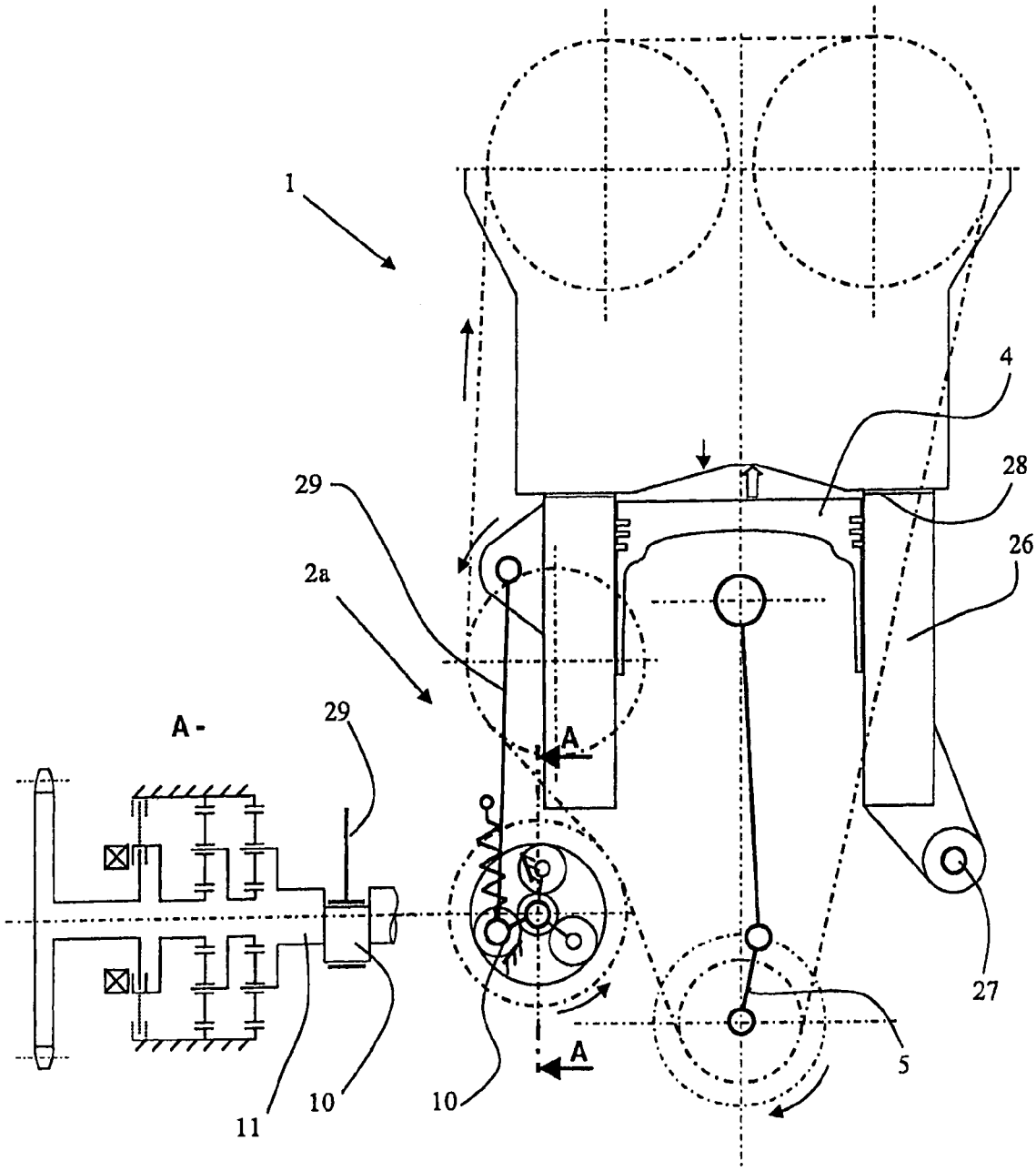
FIG. 4 is a schematic illustration of a device for changing the compression ratio including a pivotable engine cylinder.

FIG. 4 illustrates, schematically in a cross section and a partial longitudinal section, an internal combustion engine 1 having a device 2*a*, which is different from that in FIG. 1 to FIG. 3, for varying the compression ratio, in an operating state of the adjustment in the direction of a high compression. The internal combustion engine 1 has a cylinder housing 26 in which the piston 4 is movably supported. The cylinder housing 26 is mounted so as to be pivotable about a pivot axis 27, as a result of which the spacing of the upper edge 28 of the cylinder housing from the center of the crankshaft 5 can be set to different values, and the compression ratio is thereby variable. The device 2*a* is composed substantially of an eccentric 10 and an adjusting rod 29 which is fastened at one side to the eccentric and at the other end to the cylinder housing 26. The eccentric 10 is arranged on the adjusting shaft 11. As a result of the rotation of the adjusting shaft 11 and therefore of the eccentric 10, the cylinder housing is pivoted by means of the adjusting rod 29. The adjustment in the direction of high or low compression and the blocking of the adjusting shaft 11 in order to maintain the present compression takes place by means of the device 2*a* in the same way as is described in the description of the device 2 of FIG. 1 to FIG. 3.

Figure 5:
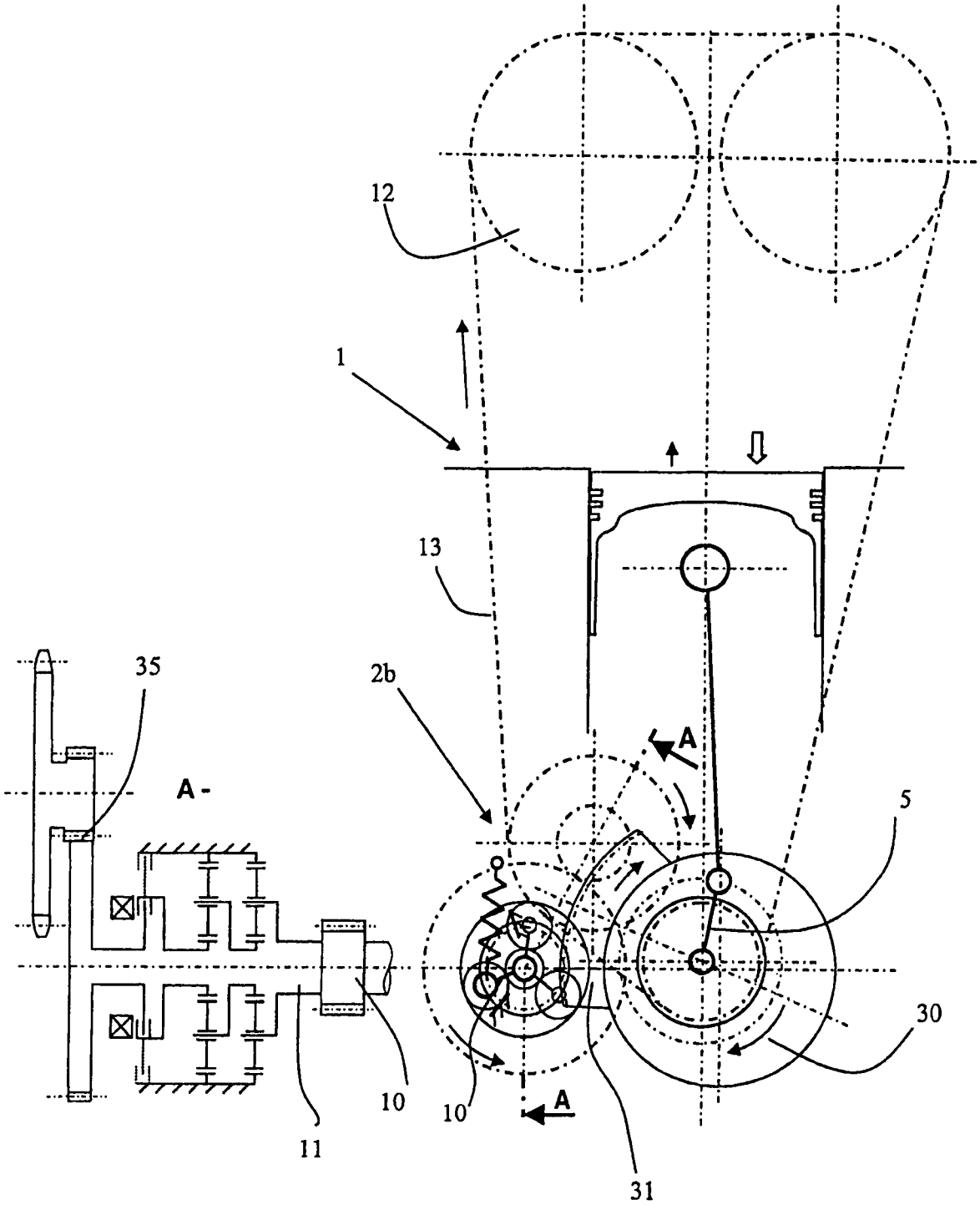
FIG. 5 is a schematic illustration of a device for changing the compression ratio including a crankshaft with adjustable lift.

FIG. 5 illustrates, schematically in a cross section and a partial longitudinal section, an internal combustion engine 1 having a device 2*b*, which is different from that in FIG. 1 to FIG. 3, for varying the compression ratio, in an operating state of the adjustment in the direction toward a high compression ratio. The internal combustion engine 1 has a crankshaft 5 whose center can be moved relative to the housing 3 of the internal combustion engine in order to thereby vary the compression ratio of the internal combustion engine. The center of the crankshaft 5 is mounted on a base bearing eccentric 30 which itself can be rotated by the device 2*b*. The device 2*b* is composed substantially of an eccentric 10 and an adjusting lever 31 which itself engages on the eccentric by means of a gearwheel connection, and is fastened at the other end to the base bearing eccentric 30. The eccentric 10 is arranged on the adjusting shaft 11 which is driven, via a step-up gearwheel mechanism 35, by the wraparound drive 13 for driving the camshaft 12. By means of the rotation of the adjusting shaft 11 and therefore of the eccentric 10, the base bearing eccentric 30 is rotated by means of the adjusting lever 31, and the compression ratio is thereby varied. The adjustment in the direction toward high or low compression ratios and the blocking of the adjusting shaft 11 in order to maintain the momentary compression ratio takes place by means of the device 2*b* in the same way as is described in the description of the device 2 of FIG. 1 to FIG. 3.

Figure 6:
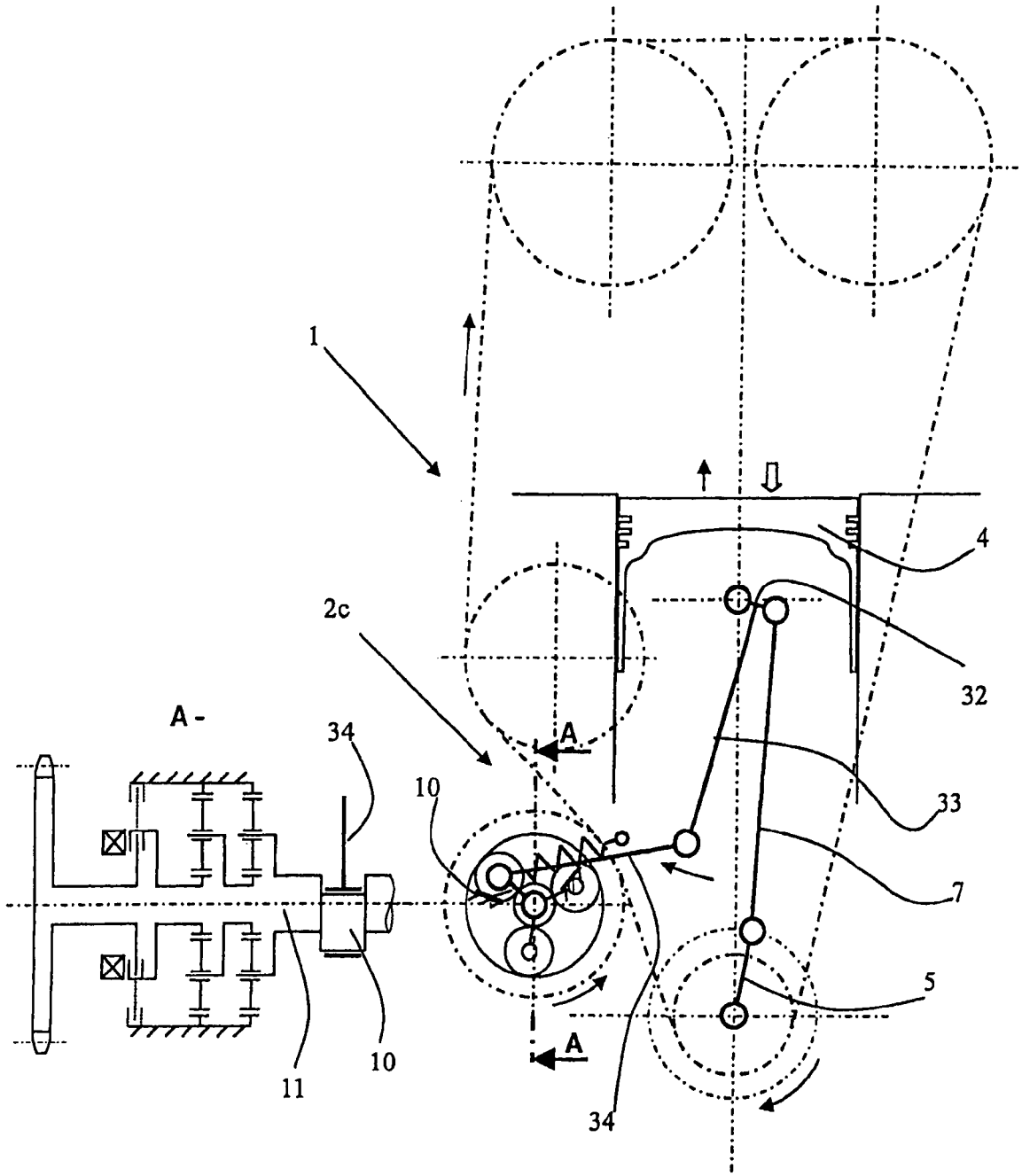
FIG. 6 is a schematic illustration of a device for changing the compression ratio includes a pivotable eccentric upper piston rod bearing.

FIG. 6 illustrates, schematically in a cross section and a partial longitudinal section, an internal combustion engine 1 having a device 2*c*, which is different from that in FIG. 1 to FIG. 3, for varying the compression ratio, in an operating state of the adjustment in the direction of a high compression. The internal combustion engine 1 has a piston 4 which is connected by means of an eccentric piston rod bearing 32 and the main piston rod 7 to the crankshaft 5. The eccentric piston rod bearing 32 is fixedly connected to a piston rod adjusting lever 33 which itself can be rotated by the device 2*c*. The device 2*c* is composed substantially of an eccentric 10 and a connecting rod 34 which itself is fastened at one end to the eccentric and at the other end to the piston rod adjusting lever 33. The eccentric 10 is arranged on the adjusting shaft 11. By means of the rotation of the adjusting shaft 11 and therefore of the eccentric 10, the piston rod adjusting lever 33 is moved by means of the connecting rod 34, the eccentric piston rod bearing 32 is rotated and the compression ratio is thereby changed. The adjustment in the direction toward a high or a low compression ratio and the blocking of the adjusting shaft 11 in order to maintain the present compression takes place by means of the device 2*c* in the same way as is described in the description of the device 2 of FIG. 1 to FIG. 3.

What is claimed is:

1. An internal combustion engine (1) including a housing (3) with cylinders arranged in the housing (3), a crankshaft (5)

and pistons (4) movably disposed in the cylinders and operatively connected to the crankshaft (5), a device (2) for varying a compression ratio of the cylinders of the internal combustion engine, the device (2) having for each cylinder with adjustable compression ratio the following elements:

an adjusting arrangement with an adjusting shaft (11) supported in the housing (3), an eccentric (10) mounted on the adjusting shaft (11) for rotating the eccentric_(10) for changing the position of the adjusting arrangement, a drive device including a clutch (15) for operative connection thereof to the crankshaft (5), a brake device (18) for locking the drive device with the housing (3) for firmly retaining the adjusting shaft (11) in a momentary position, a first housing-mounted stop (22) for limiting a rotation of the adjusting shaft (11) in a first end position and a second housing-mounted stop (23) for limiting the rotation of the adjusting shaft (11) in a second end position which is opposite the first end position.

2. The internal combustion engine (1) as claimed in claim 1, wherein the drive device includes a gearing (16) for transmitting motion from the crankshaft (5) of the engine (1) to the adjusting shaft (11).

3. The internal combustion engine (1) as claimed in claim 1, wherein the drive device is operatively connected to a wraparound drive or rolling contact gearing (13) provided for driving camshafts (12).

4. The internal combustion engine (1). as claimed in claim 1, wherein a rotational angle of the adjusting shaft (11) between the first stop (22) and second stop (23) is in a range from 100° to 150°.

5. The internal combustion engine (1) as claimed in claim 1, wherein a spring (25) is provided which biases the adjusting shaft (11) in the direction of one of the stops (23).

6. The internal combustion engine (1) as claimed in claim 1, wherein the eccentric is connected to an operating rod (9) which is connected to the piston rod (7) for adjusting the effective length thereof.

7. The internal combustion engine (1) as claimed in claim 1, wherein the eccentric is connected to an operating rod (9) which is connected to a transverse lever (8) operated by the crankshaft (5) and connected to the piston rod (7) for controlling the top dead center position and, together therewith, the compression ratio of the cylinder.

8. The internal combustion engine (1) as claimed in claim 1, wherein the eccentric is connected to an operating rod (9) which is connected to engine cylinder for moving the cylinder relative to the crankshaft.

9. The internal combustion engine (1) as claimed in claim 1, wherein the eccentric is associated with the crankshaft support for moving the crankshaft together with the piston rod and the piston relative to the cylinder.

10. A method for operating an internal combustion engine (1) including a housing (3) with cylinders arranged in the housing (3), a crankshaft (5) and pistons (4) movably disposed in the cylinders and operatively connected to the crankshaft (5), a device (2) for varying a compression ratio of the cylinders of the internal combustion engine, the device (2) having for each cylinder with adjustable compression ratio the following elements:

an adjusting arrangement with an adjusting shaft (11) supported in the housing (3), an eccentric (10) mounted on the adjusting shaft (71) for rotating the eccentric(10) for changing the position of the adjusting arrangement, a drive device including a clutch (15) for operative connection thereof to the crankshaft (5), and a brake device (18) for locking the drive device with the housing (3) for firmly retaining the adjusting shaft (11) in a momentary position, comprising the steps of: changing the compression ratio in the direction of higher compression by closing the clutch (15), with the energy for rotating the adjusting shaft (11) being extracted from the crank-shaft (5) by means of a wraparound drive and/or rolling contact gearing (13), and changing the compression ratio in the direction of low compression by the force of a spring (10).

11. The method for operating an internal combustion engine (1) as claimed in claim 10, wherein the compression ratio is changed in the direction of low compression by opening the clutch (15) and the brake device (18), with the energy for rotating the adjusting shaft (11) being extracted directly, via a transverse lever (8), from a gas pressure of the combustion gas in a combustion chamber above the piston (4).

12. The method for operating an internal combustion engine (1) as claimed in claim 10, wherein, in an operating state without any change of the compression ratio, the brake device (18) is engaged so as to prevent rotation of the adjusting shaft (11), and the clutch (15) is disengaged.

13. The method for operating an internal combustion engine (1) as claimed in claim 10, wherein a torque, which is transmitted by the clutch, is controlled by a control unit to thereby control the position of the adjusting shaft (11).

* * * * *